US006164179A

United States Patent [19]

Buffman

[11] Patent Number: 6,164,179

[45] Date of Patent: Dec. 26, 2000

[54] SUBMARINE DEPLOYABLE VERTICAL LAUNCH SPAR BUOY

[75] Inventor: Martin Buffman, Little Compton, R.I.

[73] Assignee: The United States of America as represented by the Secretary of the Navy, Washington, D.C.

[21] Appl. No.: 09/168,336

[22] Filed: Oct. 5, 1998

[51] Int. Cl.[7] ..... F41F 3/07

[52] U.S. Cl. ..... 89/1.81; 89/1.809; 89/1.815; 89/1.816; 89/1.817; 114/316

[58] Field of Search ..... 89/5, 1.809, 1.81, 89/1.816, 1.817, 1.818, 1.815, 1.811, 1.813; 114/316, 317

[56] References Cited

U.S. PATENT DOCUMENTS

| | | | |
|---|---|---|---|
| 3,137,203 | 6/1964 | Brown | 89/1.81 |
| 3,279,319 | 10/1966 | Semonian et al. | 89/1.81 |
| 4,147,124 | 4/1979 | Brooks et al. | 89/1.81 |
| 5,022,470 | 6/1991 | Andersen et al. | 248/171 |
| 5,170,005 | 12/1992 | Mabry et al. | 89/1.81 |

*Primary Examiner*—Stephen M. Johnson

*Attorney, Agent, or Firm*—Michael J. McGowan; James M. Kasischke; Prithvi C. Lall

[57] ABSTRACT

The present invention relates to a system and a method for launching an aeronautical vehicle from a submerged platform such as a submarine. The system includes a buoy configured to be deployed from a launching tube onboard the submerged platform, which buoy contains the aeronautical vehicle to be launched. The system further includes a gas generator for creating a pressure force which causes the buoy with the encapsulated aeronautical vehicle to be deployed from the launch platform. Once deployed, the buoy inflates a buoyancy device for putting the buoy in a partially submerged position and damping plates for resisting vertical movement of the buoy and wave motion. The buoy has a ballast arrangement for maintaining it in a substantially vertical orientation. The buoy further has an antenna for receiving commands to launch the aeronautical vehicle. The method for launching the aeronautical vehicle from the underwater platform broadly comprises the steps of: providing a buoy containing an aeronautical vehicle; deploying the buoy from the underwater platform into a water environment where the buoy is partially submerged beneath the surface of the water in a substantially vertical position; and launching the vehicle from the buoy while the buoy is in the substantially vertical position.

17 Claims, 4 Drawing Sheets

SUBMARINE DEPLOYABLE VERTICAL LAUNCH SPAR BUOY

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The present invention relates to a system and a method for launching an aeronautical vehicle, and in particular, to a system and a method for launching an unmanned aeronautical vehicle from a submerged launching platform.

(2) Description of the Prior Art

Over the years, a variety of schemes for deploying missiles from beneath the surface of the ocean have been developed. For example, U.S. Pat. No. 3,158,062 to Feiler describes a launching tube for a missile, which launching tube is designed to protect the missile while it is being transported to its launch site. The Feiler launching tube is further designed to be anchored in an upright position so that the missile stored within can be launched vertically.

U.S. Pat. No. 4,586,421 illustrates yet another vertically oriented, underwater launch tube for a missile. The launch tube comprises an elongate outer container which is buried or partially buried in the sea bed in an upright position. The container uses devices at its bottom end for removing sand or silt and an auger for boring a hole in the sea bed or a rotary stirrer. The missile is housed within an inner container which is telescopically arranged within the outer container.

U.S. Pat. No. 5,092,222 to Lynch illustrates a float-up launching system for launching missiles from submerged submarines or other submerged launchers which utilizes a lightweight rigid cylindrical tube telescoped over the missile while stored in the launcher. On launching, the tube is extended forward of the missile by a gas generator to form a floatation chamber which creates extra buoyancy forward of the missile center of gravity. This lifts the missile nose upward to the water surface allowing ignition of the missile booster motors and launch of the missile.

U.S. Pat. No. 5,076,192 to Tegel et al. illustrates an unmanned submarine launching system which is guided to the surface of the water in order to launch an air rocket contained therein and which is provided in its walls with closeable openings for the discharge of the rocket recoil gases into the surrounding water to conduct the impinging recoil gases of a launched air rocket directly out of the submarine.

U.S. Pat. No. 4,854,260 to Woidich et al. illustrates a configuration in which bodies such as torpedoes can be held in an additional container inside a torpedo tube in a submarine. The container is in the manner of an interior tube. The annular space between the torpedo and its tube is used to hold damping elements, which are located individually or over the entire structure of the torpedo, and the annular space is kept free of water by means of sealing elements. Another damping element is positioned in the rear portion of the container in the torpedo tube.

U.S. Pat. No. 5,542,333 to Hagelberg et al. illustrates an undersea vehicle storage and ejection system which includes a capsule having a cavity for storing and launching a vehicle. The capsule has an opening at one end for passage of the vehicle therethrough. A closure member is adapted to be mated with the housing at the opening to seal the cavity. A rocket unit is incorporated within the capsule to remove the closure member at launch. The closure member includes a sealing arrangement for withstanding the hydrostatic pressure when the system is in the undersea environment of use and block the entry of sea water into the cavity. The rocket unit, when ignited, rapidly builds up pressure within the capsule to a level exceeding the external hydrostatic pressure on the cover, thereby removing the cover so that the vehicle may be launched.

Submarines have been previously provided with the capability of launching airborne vehicles such as Tomahawk missiles both through vertical launch via specialized launch tubes on the submarine and horizontal launch via the submarine's torpedo tubes. With both launch methods, the angle the missile breaks through the water surface is critical. One of the deficiencies of these systems is that the missile cannot be deployed without revealing the location of the launching submarine. Large missiles, such as the Tomahawk, are expensive because of the need to support a large warhead for deployment against hardened ground based targets.

Fixed air support missiles (FASM) have been developed for multiple missions. The fixed air support missile is a class of small missile which can be used against airborne targets such as helicopters, can be deployed to provide aerial surveillance, or can be used for ground support missions. These missiles are relatively small and cheap. They have not been deployed on submarines because of launching considerations.

SUMMARY OF THE INVENTION

Accordingly, it is an object of the present invention to provide a system for launching small aeronautical vehicles from submerged vehicles or platforms.

It is another object of the present invention to provide a system as above which has a relatively low cost attached to it.

It is yet another object of the present invention to provide a system as above for launching an aeronautical vehicle which can perform a wide variety of aerial support, surveillance or ground attack missions.

It is still another object of the present invention to provide a method for launching an aeronautical vehicle from a submerged vehicle or platform.

The foregoing objects are attained by the launching system of the present invention.

In accordance with the present invention, a system for launching an aeronautical vehicle from a submerged platform comprises a buoy having a closed first end, sidewalls, an open second end, and a cap sealing the open second end. An aeronautical vehicle is completely positioned within the buoy. The buoy containing the aeronautical vehicle can be deployed from a launch tube onboard the submerged launch platform and the aeronautical vehicle can be deployed from the buoy. The buoy, in a preferred embodiment, has means for stably maintaining the tube partially beneath the surface of the water in a substantially vertical orientation. The buoy further has an antenna for receiving commands to launch the aeronautical vehicle while the buoy is in its substantially vertical, partially submerged position.

The method for launching the aeronautical vehicle from the underwater platform includes the steps of deploying a buoy containing an aeronautical vehicle from the underwater platform into a water environment where the buoy is partially submerged beneath the surface of the water in a substantially vertical position; and launching the vehicle from the buoy while the buoy is in the substantially vertical, partially submerged position.

Other details of the system and the method of the present invention as well as other objects and advantages attendant thereto are set forth in the following description and drawings wherein like reference numerals depict like elements.

DETAILED DESCRIPTION OF THE PREFERRED EMBODIMENT(S)

Figure 1:
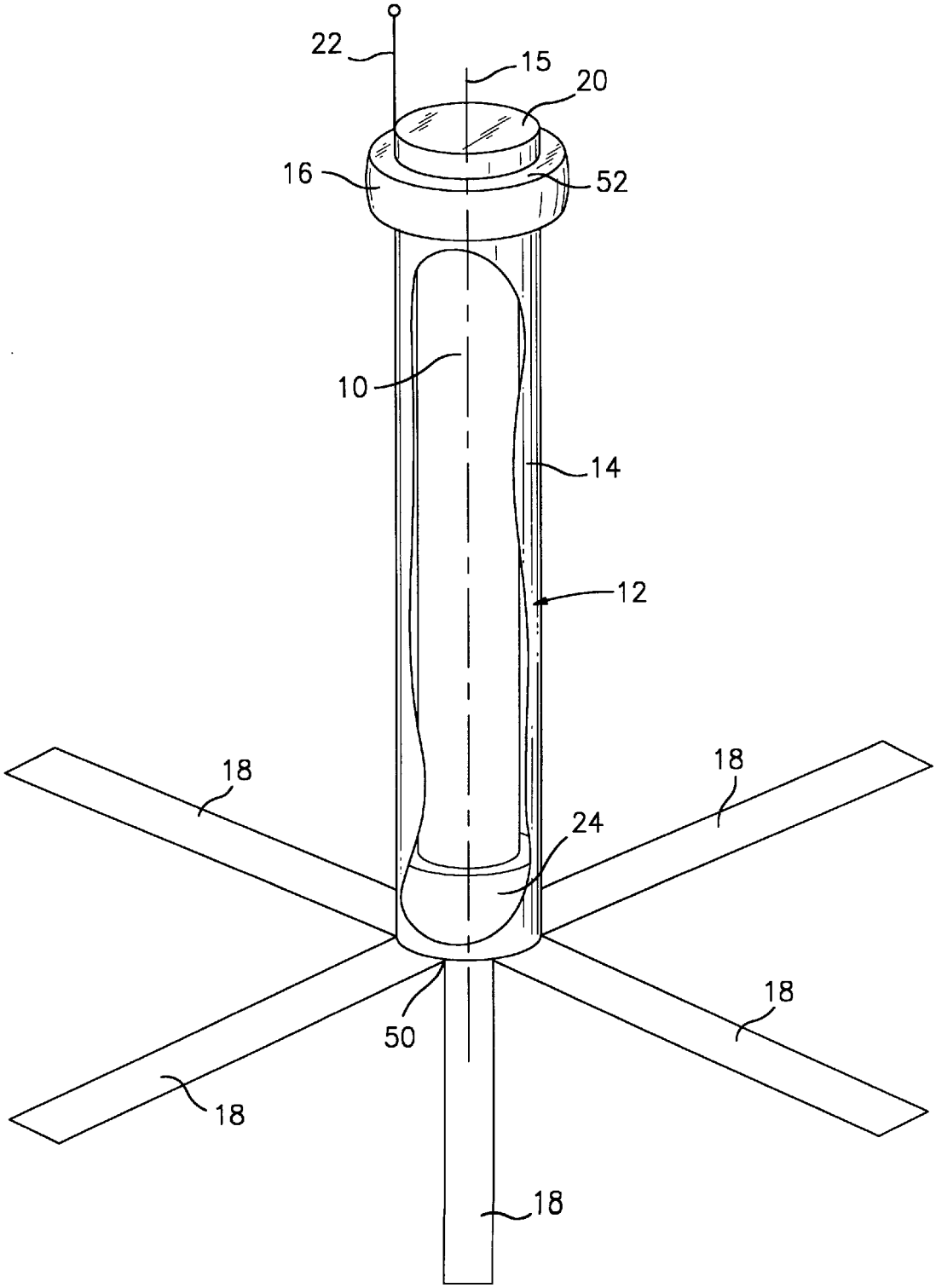
FIG. 1 is a perspective, partially cut-away view of a spar buoy in accordance with the present invention containing an aeronautical vehicle to be launched.
Figure 2:
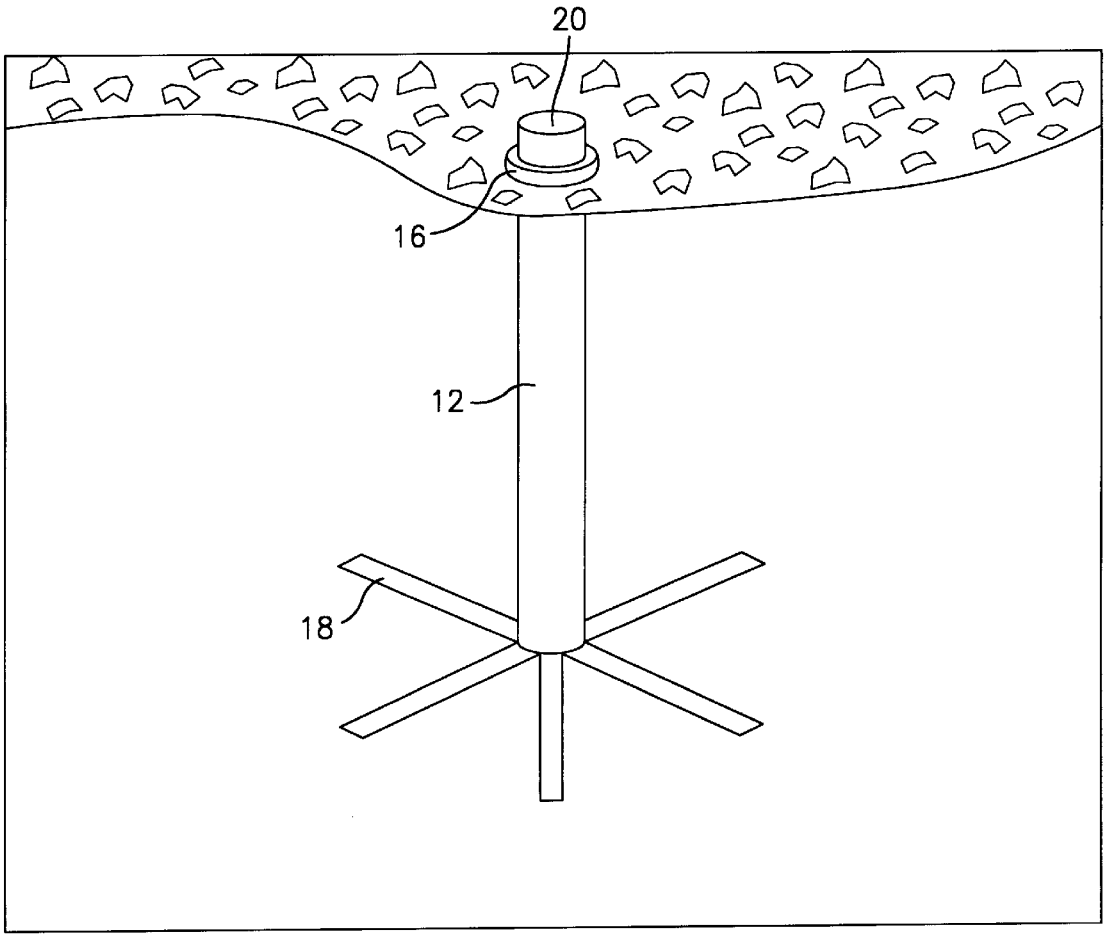
FIG. 2 illustrates the spar buoy of FIG. 1 in a partially submerged position ready for launch of the aeronautical vehicle therein.

Referring now to the drawings, FIG. 1 illustrates a partially cut away view of the spar buoy 12 of the present invention. As shown therein, an aeronautical vehicle 10 to be launched is installed within the buoy 12. The buoy 12 is formed by a cylindrically shaped body 14 having a closed bottom end 50 and an open top end 52 which is closed by a cap 20. The body 14 also has a longitudinal axis 15. An inflatable buoyancy device 16 is positioned around the outside of the body 14 adjacent the top end 52 so as to allow the buoy 12 to assume a partially submerged position, as shown in FIG. 2, when the device 16 is inflated.

A plurality of damping plates 18 are hinged to the bottom end 50 of the buoy 12 such that the forces created upon deployment of the buoy 12 from the submerged platform cause the plates 18 to open. The damping plates 18 resist vertical movement of the buoy 12 and assist in stabilizing the buoy 12 as a launching platform. The damping plates 18 also help resist motion caused by waves and motion caused by recoil from the launch of the aeronautical vehicle 12. Once opened, the damping plates 18 can be latched into a substantially horizontal position which is substantially perpendicular to the longitudinal axis 15 as shown in FIG. 2. If desired, springs (not shown) can be provided to open the damping plates 18 from their stored position adjacent the body 14 of the buoy 12.

The cap 20 positioned at the top end of the cylindrical body 14 seals the body 14 against the entry of sea water. The cap 20 can be a light rubber or Mylar sealing membrane.

The buoy 12 is ballasted at its bottom end 50 to preserve a substantially vertical orientation of the buoy in the surrounding sea water after it has been launched from the submerged platform.

An optional antenna 22 is positioned adjacent the top of the body 14. The antenna 22 communicates with an internal control circuit 24 positioned at the bottom end 50 of the body 14. Control circuit 24 may comprise any suitable control circuit known in the art and may be joined to the antenna 22 in any desired manner so as to receive radio commands. Upon receiving a launch command, control circuit 24 issues a signal to the aeronautical vehicle 10 to launch. Any suitable means known in the art may be used to transmit the signal from control circuit 24 to the aeronautical vehicle 10. As an alternative, launch can be initiated by a timer or occurrence of external events. The aeronautical vehicle 10 begins its launch sequence when the signal is received. After the aeronautical vehicle fires its onboard engine (not shown), it penetrates the cap 20 and is launched, all while the buoy 12 remains partially submerged beneath the surface of the water and in a substantially vertical orientation.

Figure 3:
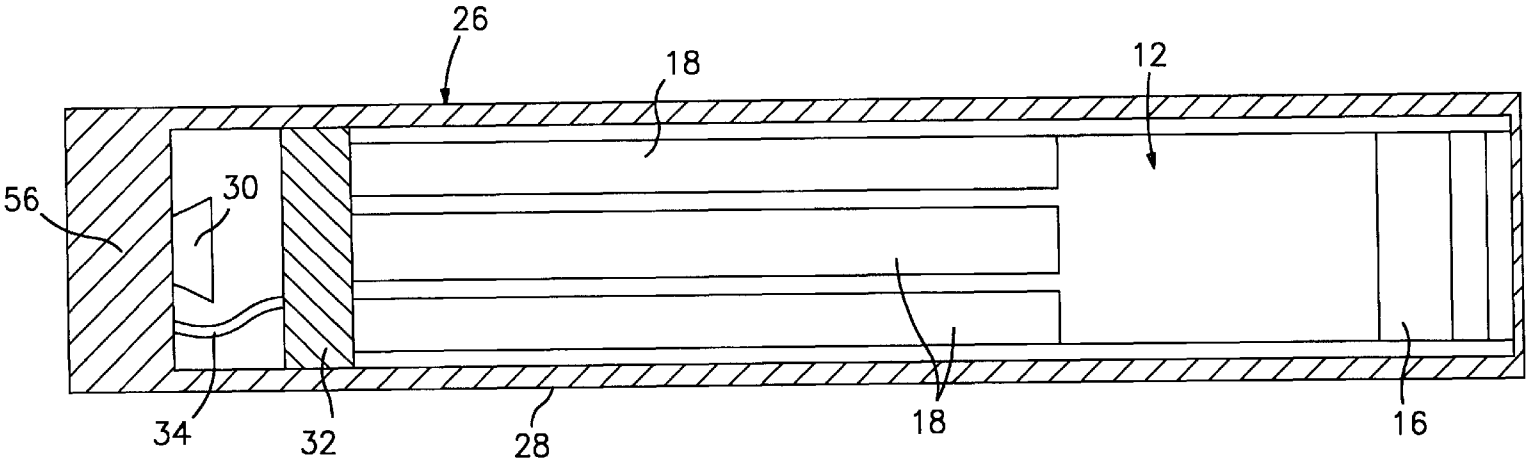
FIG. 3 is a sectional view of a launch tube containing the buoy of FIG. 1.

FIG. 3 illustrates the buoy 12 in a launch capsule 26. As shown therein, when the buoy 12 is positioned within the capsule 26, the damping plates 18 are folded against the body 14 of the buoy 12. Additionally, the buoyancy device 16 is in an uninflated state. The capsule 26 comprises a hollow launch tube 28 having a muzzle end 54 from which the buoy 12 is launched and an aft end 56. Positioned at the aft end 56 is a gas generator 30. A ram plate 32 is slidably positioned within the launch tube 28 in a location toward the muzzle end 54. The spar buoy 12 to be launched or deployed is positioned against the ram plate 32. A communications cable 34 extends from the aft end 56 through the ram plate 32 to the buoy 12.

Upon launch or deployment of the buoy 12, the gas generator 30 fires a generating pressure behind the ram plate 32. As the pressure force builds up against it, the ram plate 32 moves towards the muzzle end 54 and pushes the spar buoy 12 out of the launch tube 28. At or just prior to launch, a signal is transmitted to the spar buoy control circuitry 24 via communications cable 34 in order to indicate that a launch is about to occur. Control cable 34 disconnects during the launch or deployment procedure. After launch of the spar buoy 12 into the surrounding sea water, the control circuit 24 sends a signal to the buoyancy device 16 to inflate and thereby hold the buoy 12 in a substantially vertical position beneath the surface of the sea water.

Figure 6:
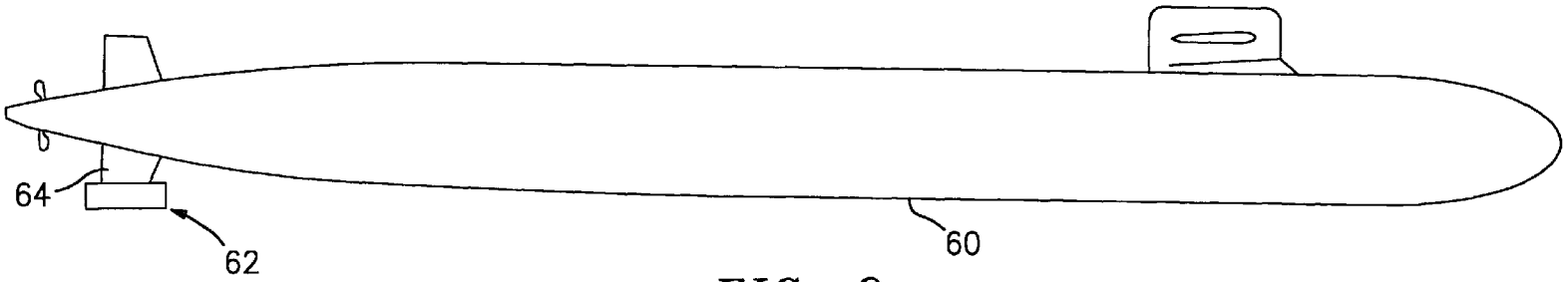
FIG. 6 illustrates a submarine having a housing containing one or more launch tubes attached to a fin.
Figure 4:
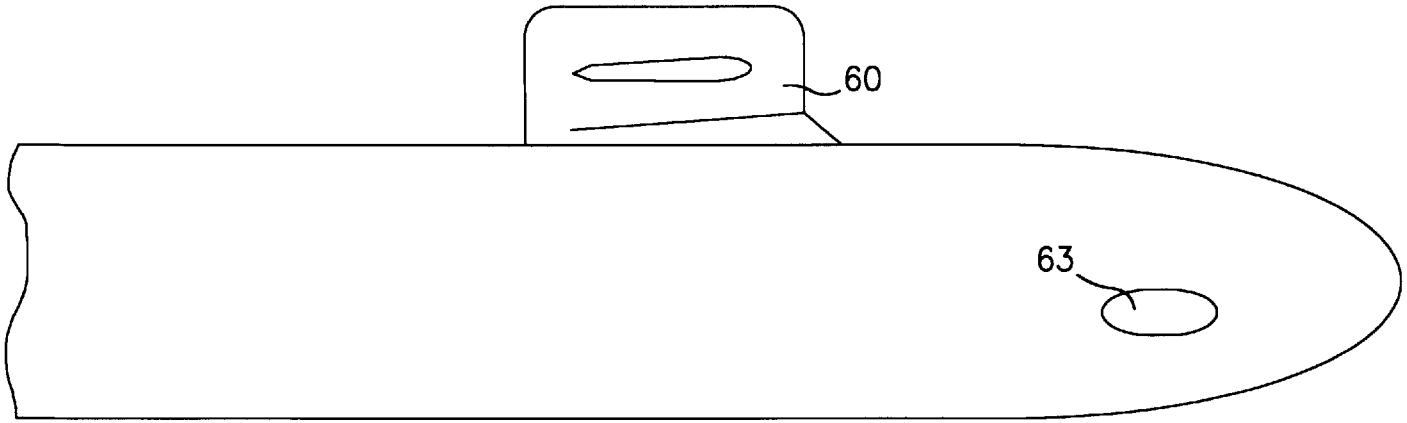
FIG. 4 illustrates a submarine having forward torpedo tubes.
Figure 5:
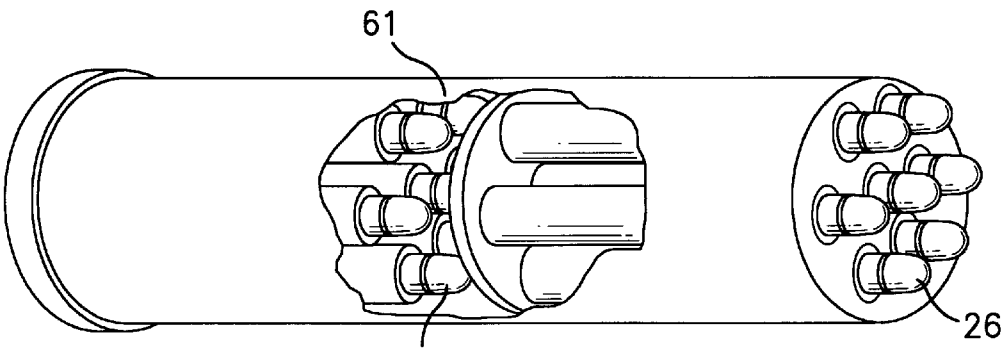
FIG. 5 illustrates a canister containing a plurality of launch tubes which may be used with the submarine of FIG. 4.

There are several options for deployment of a spar buoy containing an aeronautical vehicle to be launched from a submarine 60 or other submerged platform (not shown). One option is via a torpedo tube launch as shown in FIG. 4. In this option, up to fourteen launchers 26, each having a spar buoy positioned therein, can be deployed in a housing or canister 61 such as that shown in FIG. 5. In this configuration, launchers 26 are positioned in canister 61 in two layers of seven. Canister 61 can have control circuitry therein for selectively deploying launchers 26. The canister can be launched from a submarine torpedo tube 63. In a second option, as shown in FIG. 6, the launchers 26 are positioned in a housing 62 located on a submarine tail fin 64. Housing 62 can be similar to canister 61. Control circuitry 24 can be linked to submarine controls.

The method for launching an aeronautical vehicle in accordance with the present invention comprises deploying the buoy 12 containing the aeronautical vehicle 10 from a launcher 26 onboard the submerged platform. This is accomplished by firing a gas generator 30 which generates pressure behind buoy 12 and causes the buoy 12 to be pushed out of the launcher 26 into the surrounding sea water. After the buoy 12 has left the launcher 26, the control circuit 24 sends a signal to the inflatable buoyancy device 16 to inflate so as to maintain the buoy 12 in a desired position, partially submerged beneath the surface of the sea water. Additionally, the damping plates 18 open up so as to assume a substantially horizontal position after the buoy 12 stabilizes in a substantially vertical position. The aeronautical vehicle 10 can be launched when a radio command is received by the control circuit 24 via the antenna 22. The control circuit 24 then issues a command to the vehicle 10 to commence launch at which point the firing of the vehicle's onboard engine (not shown) commences. The firing of the engine causes the vehicle 10 to penetrate the cap 20 and rise out of the buoy 12. Other circumstances such as sensor input can also be used by control circuit 24 to determine a launch.

The present invention offers several advantages. First, it provides a submarine with a new small device launch capability for aerial support, surveillance, and ground attack. Second, the launch system of the present invention makes use of existing hardware; accordingly, deployment expenses are low. Third, the aeronautical vehicle is launched from a position remote from the submarine or other submerged platform; thus, avoiding the problem of knowing the location of the submarine from the launch of the vehicle.

While it has been disclosed the launch of the aeronautical vehicle takes place after receipt of a radio signal, it is also possible to launch the vehicle using a time delay circuit or by acoustic command. Time delay merely requires that additional commands be provided by the control circuit 24. Use of an acoustic command requires the provision of a hydrophone and an acoustic modem.

It is apparent that there has been provided in accordance with this invention a submarine deployable UAV spar buoy which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A system for launching an aeronautical vehicle from a launch platform which comprises:

a buoy having a cylindrical body with a closed first end, sidewalls, and an open second end;

a cap closing said open second end, said aeronautical vehicle to be launched being completely positioned within said cylindrical body;

a first means for deploying said buoy containing said aeronautical vehicle from said launch platform into a surrounding water environment;

a second means for deploying said aeronautical vehicle from said buoy;

an internal control circuit positioned within said buoy; and a communicating means positioned between said launch platform and said buoy for communicating with said internal control circuit.

2. The system of claim 1 wherein said first deploying means comprises:

a launch tube connected to said launch platform; and means for ejecting said buoy from said launch tube.

3. The system of claim 2 wherein said ejecting means comprises:

a plate within said launch tube abutting one end of said buoy; and means for generating a pressure force against said plate opposite said buoy for causing said buoy to be ejected from said launch tube.

4. The system of claim 3 wherein said pressure force generating means comprises a gas generator.

5. The system of claim 1 wherein said communicating means comprises a communications cable joined to said internal control circuit for indicating to the control circuit that a launch is about to occur.

6. The system of claim 1 wherein said launch platform comprises a submarine having a torpedo tube and said first deploying means includes a housing to be deployed from said torpedo tube, said housing having at least one launch tube for deploying at least one said buoy.

7. The system of claim 1 wherein said launch platform comprises a submarine and said first deploying means includes a housing positioned on the exterior of said submarine, said housing having at least one launch tube for deploying at least one said buoy.

8. The system of claim 1 wherein said buoy further comprises means for resisting vertical movement of said buoy so as to provide a stable platform for deployment of said aeronautical vehicle.

9. The system of claim 8 wherein said means for resisting vertical movement comprises a plurality of damping plates positioned adjacent said closed first end of said buoy, said damping plates being positioned adjacent said body of said buoy while said buoy is positioned within said first deploying means and being extended at right angles to a longitudinal axis of said buoy when in a deployed position.

10. The system of claim 1 wherein said buoy includes:

an inflatable buoyancy device positioned adjacent said second end of said buoy, said buoyancy device being inflated after deployment of said buoy from said launch platform; and ballast positioned adjacent said first end to preserve a substantially vertical orientation of said buoy after deployment of said buoy into the surrounding sea water.

11. The system of claim 1 where said cap seals said buoy against the entry of sea water.

12. The system of claim 11 wherein said cap is formed from light elastomeric sealing membrane.

13. The system of claim 1 wherein said communicating means comprises an antenna positioned adjacent said second end of said buoy, said internal control circuit being joined to said antenna for receiving command signals.

14. The system of claim 13 further comprising:

said second deploying means comprising an engine on said aeronautical vehicle; and said control circuit issuing a signal to said aeronautical vehicle to initiate firing of said engine and thereby cause said aeronautical vehicle to penetrate said cap.

15. A method of launching an aeronautical vehicle from an underwater platform comprising the steps of:

providing a buoy containing an aeronautical vehicle;

positioning said buoy within a launch tube adjacent a plate;

providing a signal to a control circuit within said buoy that launch is about to occur;

creating a pressure force against said plate which causes said buoy to move out of said launch tube; and launching said vehicle from said buoy while said buoy is in a substantially vertical, partially submerged position.

16. The method of claim 15 further comprising:

providing buoyancy at an upper end of said buoy after deployment;

providing ballast at a lower end of said buoy;

deploying a plurality of damping plates outwardly of said buoy after said buoy has moved out of said launch tube for resisting vertical movement of said buoy, wave motion, and recoil motion; and latching said damping plates in said outward position.

17. The method of claim 16 wherein said aeronautical vehicle launching step comprises:

transmitting a launch command to said control circuit; and transmitting said launch command to said aeronautical vehicle to initiate firing of an engine on said aeronautical vehicle and thereby causing said aeronautical vehicle to penetrate a cap on said buoy as said vehicle rises out of said buoy.

* * * * *